US009260281B2

(12) United States Patent
Davi et al.

(10) Patent No.: US 9,260,281 B2
(45) Date of Patent: Feb. 16, 2016

(54) LIFT EFFICIENCY IMPROVEMENT MECHANISM FOR TURBINE CASING SERVICE WEDGE

(71) Applicant: General Electric Company, Schenectady, NY (US)

(72) Inventors: Michael Alan Davi, Niskayuna, NY (US); Thomas James Batzinger, Burnt Hills, NY (US)

(73) Assignee: General Electric Company, Schenectady, NY (US)

( * ) Notice: Subject to any disclaimer, the term of this patent is extended or adjusted under 35 U.S.C. 154(b) by 388 days.

(21) Appl. No.: 13/799,652

(22) Filed: Mar. 13, 2013

(65) Prior Publication Data

US 2014/0271092 A1 Sep. 18, 2014

(51) Int. Cl.

| | |
|---|---|
| ***F01D 25/24*** | (2006.01) |
| ***B66F 19/00*** | (2006.01) |
| ***F01D 25/28*** | (2006.01) |
| ***B66C 23/18*** | (2006.01) |

(52) U.S. Cl.

CPC ..... *B66F 19/00* (2013.01); *B66C 23/18* (2013.01); *F01D 25/24* (2013.01); *F01D 25/28* (2013.01); *F01D 25/285* (2013.01)

(58) Field of Classification Search

CPC ..... F01D 25/24; F01D 25/243; F01D 25/26

USPC ..... 415/118, 201

See application file for complete search history.

(56) References Cited

U.S. PATENT DOCUMENTS

| | | | | |
|---|---|---|---|---|
| 2,851,214 | A * | 9/1958 | Busquet | 415/129 |
| 3,741,680 | A | 6/1973 | Killmann et al. | |
| 3,917,432 | A | 11/1975 | Feuerstein et al. | |
| 3,936,217 | A | 2/1976 | Travaglini et al. | |
| 4,011,017 | A | 3/1977 | Feuerstein et al. | |
| 4,137,006 | A | 1/1979 | Becker | |
| 4,199,301 | A * | 4/1980 | Meylan | 415/201 |
| 4,268,221 | A | 5/1981 | Monsarrat et al. | |
| 4,412,782 | A | 11/1983 | Monsarrat | |

(Continued)

FOREIGN PATENT DOCUMENTS

| | | |
|---|---|---|
| CH | 595546 A5 | 2/1978 |
| EP | 0696985 | 2/1996 |

(Continued)

OTHER PUBLICATIONS

European Search Report and Written Opinion issued in connection with corresponding EP Application No. 14157949.0-1610 dated Jul. 7, 2014.

*Primary Examiner* — Igor Kershteyn
*Assistant Examiner* — Woody A Lee, Jr.
(74) *Attorney, Agent, or Firm* — Ernest G. Cusick; Frank A. Landgraff

(57) ABSTRACT

A lift efficiency improvement mechanism is provided for use with a service wedge configured to be removably installed in an access slot of a turbine casing. The lift efficiency improvement mechanism includes a connector element, which is connectable with the turbine casing proximate to the access slot and a manually transportable lift efficiency improvement device, which is supportably coupled to the connector element and movably coupled to the service wedge. The lift efficiency improvement device is configured to urge the service wedge to move relative to the access slot responsive to corresponding operator control movement.

20 Claims, 6 Drawing Sheets

(56) References Cited

U.S. PATENT DOCUMENTS

| | | | | |
|---|---|---|---|---|
| 5,273,393 | A | 12/1993 | Jones et al. | |
| 5,350,136 | A | 9/1994 | Prosser et al. | |
| 5,605,438 | A | 2/1997 | Burdgick et al. | |
| 5,755,403 | A | 5/1998 | Marche | |
| 5,803,405 | A | 9/1998 | Ellis et al. | |
| 5,975,463 | A | 11/1999 | Gruensfelder et al. | |
| 6,220,546 | B1 | 4/2001 | Klamka et al. | |
| 6,336,789 | B1 | 1/2002 | Beerens et al. | |
| 6,471,473 | B1 | 10/2002 | Wilkinson et al. | |
| 6,622,963 | B1 | 9/2003 | Ahrendt et al. | |
| 6,663,047 | B1 | 12/2003 | Arata | |
| 6,691,019 | B2 | 2/2004 | Seeley et al. | |
| 6,868,366 | B1 | 3/2005 | Eisenzopf | |
| 7,044,685 | B2 * | 5/2006 | Wybro et al. | 405/207 |
| 7,255,307 | B2 | 8/2007 | Mayes | |
| 7,326,031 | B2 | 2/2008 | O'Neill et al. | |
| 7,458,768 | B2 | 12/2008 | Dube et al. | |
| 7,503,523 | B2 | 3/2009 | Perez-Sanchez | |
| 7,703,716 | B2 | 4/2010 | Bulin | |
| 7,721,525 | B2 | 5/2010 | Shutrump | |
| 7,726,022 | B2 | 6/2010 | Trbojevic et al. | |
| 7,766,614 | B2 | 8/2010 | Northfield | |
| 7,789,347 | B2 | 9/2010 | Oberle et al. | |
| 7,909,289 | B2 | 3/2011 | Perez-Sanchez | |
| 7,938,359 | B2 | 5/2011 | Guibert et al. | |
| 7,959,106 | B2 | 6/2011 | Guibert et al. | |
| 7,994,940 | B2 | 8/2011 | Grichener et al. | |
| 8,021,109 | B2 | 9/2011 | Kneeland et al. | |
| 8,047,769 | B2 | 11/2011 | Ballard, Jr. | |
| 8,075,261 | B2 | 12/2011 | Merry et al. | |
| 8,109,467 | B2 | 2/2012 | Murphy | |
| 8,128,353 | B2 | 3/2012 | Flanagan et al. | |
| 8,172,528 | B2 | 5/2012 | Kawakami et al. | |
| 8,210,802 | B2 | 7/2012 | Kneeland et al. | |
| 8,210,804 | B2 | 7/2012 | Maier et al. | |
| 8,246,298 | B2 | 8/2012 | Wilson | |
| 8,267,437 | B2 | 9/2012 | Maier | |
| 2007/0212217 | A1 | 9/2007 | Northfield | |
| 2009/0129922 | A1 | 5/2009 | Cloft et al. | |
| 2009/0202340 | A1 | 8/2009 | Ballard, Jr. | |
| 2010/0215477 | A1 | 8/2010 | Wilson | |
| 2010/0296926 | A1 | 11/2010 | Arase et al. | |
| 2011/0020117 | A1 * | 1/2011 | Kondo et al. | 415/182.1 |
| 2012/0093641 | A1 | 4/2012 | Chieco | |
| 2012/0125523 | A1 * | 5/2012 | Dupre | 156/98 |
| 2012/0195746 | A1 | 8/2012 | Sarda | |
| 2012/0272496 | A1 * | 11/2012 | Herbold | F01D 25/285 29/402.03 |

FOREIGN PATENT DOCUMENTS

| | | | |
|---|---|---|---|
| EP | 1832755 | A2 | 9/2007 |
| WO | 9426591 | | 11/1994 |

* cited by examiner

LIFT EFFICIENCY IMPROVEMENT MECHANISM FOR TURBINE CASING SERVICE WEDGE

BACKGROUND OF THE INVENTION

The subject matter disclosed herein relates to a lift efficiency improvement mechanism for turbine casings and, more particularly, to a lift efficiency mechanism for a turbine casing service wedge.

Gas and steam turbine engines are typically designed with casing/shell splits along the horizontal centerline of the unit. For major maintenance inspections, parts replacements, etc., the upper half casings are normally removed. The disassembly and subsequent re-assembly process is mechanically very involved along with being resource and time intensive. For example, it is necessary to attach the upper half casing to a crane and to remove fastening elements along the entire axial length of both casing/shell splits so that the crane can lift the upper half casing away from the lower half casing.

For small to medium scale inspection, maintenance, cleaning, repair or replacement operations, the ability of the operator to access the interior of casings/shells is often compromised. As such, it may be necessary for the entire removal process to be conducted even for relatively minor operations if internal access to parts is required. This issue can be especially resource and time intensive particularly as compared to the scope of the relatively small scale maintenance, repair or replacement operations.

BRIEF DESCRIPTION OF THE INVENTION

According to one aspect of the invention, a lift efficiency improvement mechanism is provided for use with a service wedge configured to be removably installed in an access slot of a turbine casing. The lift efficiency improvement mechanism includes a connector element, which is connectable with the turbine casing proximate to the access slot and a manually transportable lift efficiency improvement device, which is supportably coupled to the connector element and movably coupled to the service wedge. The lift efficiency improvement device is configured to urge the service wedge to move relative to the access slot responsive to corresponding operator control movement.

According to another aspect of the invention, a lift efficiency improvement mechanism is provided for use with a service wedge configured to be removably installed in an access slot of a turbine casing. The lift efficiency improvement mechanism includes a connector element, which is connectable with the turbine casing proximate to the access slot and a force multiplication device, which is supportably coupled to the connector element and movably coupled to the service wedge. The connector element and the force multiplication device are manually transportable. The force multiplication device is configured to urge the service wedge to move relative to the access slot responsive to corresponding operator control movement.

According to yet another aspect of the invention, a method of improving lift efficiency of a service wedge configured to be removably installed in an access slot of a turbine casing is provided. The method includes disposing a connector element in connection with the turbine casing proximate to the access slot, manually transporting a lift efficiency improvement device to the connector element, supportably coupling the lift efficiency improvement device to the connector element, movably coupling the lift efficiency improvement device to the service wedge and employing the lift efficiency improvement device to urge the service wedge to move relative to the access slot.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

In accordance with aspects, the resources and time intensity of inspections, replacement and repair of rotating and/or stationary parts of gas or steam turbine engines can be dramatically reduced. This may be accomplished by employing at least one or more removable wedge segments as relatively small portions of the complete lower or upper casing or shell. The smaller wedge segments may weigh as little as about 40-1,000 lbs., and can be more efficiently removed than the lower or upper casing or shell during an outage. The wedge segments will allow for direct operator access to blading for more complete inspections, cleaning or repair than can be achieved via a small diameter (typically 2 cm or less) borescope opening. In addition, with proper foresight the blading can be designed for replacement via the access slots formed for the wedge segments to thereby save valuable outage time, reduce lift requirements and afford more complete inspections with complete removal of the upper casings.

In accordance with further aspects of the invention, the one or more removable wedge segments are manually lifted and removed from the lower or upper casing or shell by an operator who may be using a lift efficiency improvement mechanism. The lift efficiency improvement mechanism can, in some cases, rely upon force addition, guidance tools and force multiplication and may be mountable onto the lower or upper casing or shell and may be hand carried by the operator. In general, the lift efficiency improvement mechanism precludes the need for a large capacity crane.

Figure 1:
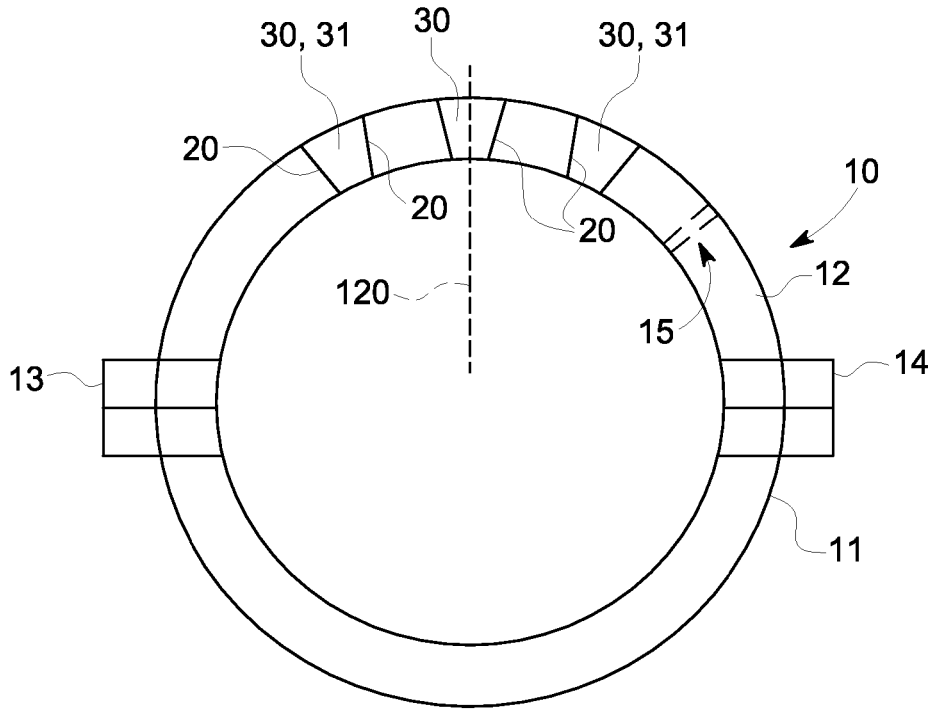
FIG. 1 is an axial view of a turbine casing in accordance with embodiments.
Figure 2:
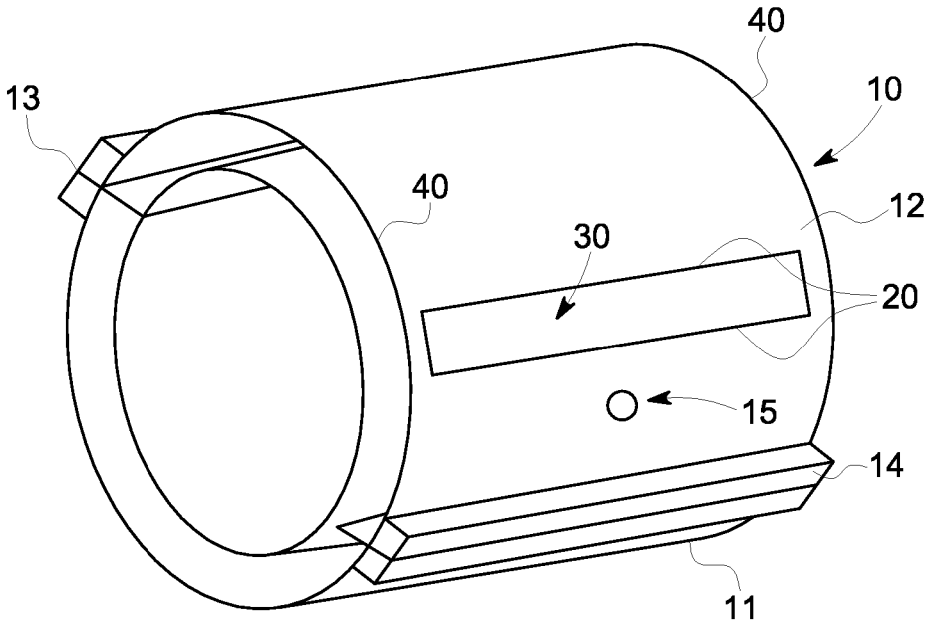
FIG. 2 is a perspective view of the turbine casing of FIG. 1.
Figure 3:
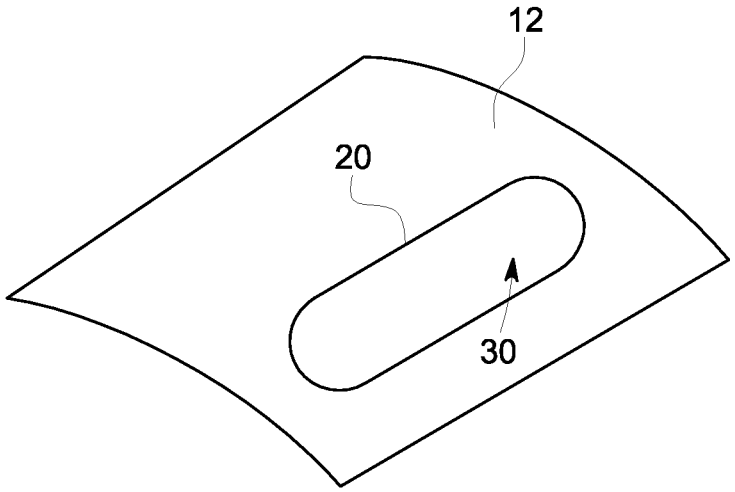
FIG. 3 is a perspective view of the turbine casing in accordance with alternative embodiments.

With reference to FIGS. 1, 2 and 3, a turbine casing 10 is provided. The turbine casing 10 includes a first or lower hemispherical turbine casing shell (hereinafter referred to as "a lower turbine casing shell") 11, a second or upper hemispherical turbine casing shell (hereinafter referred to as "an upper turbine casing shell") 12 and at least one service wedge 30. The upper turbine casing shell 12 is configured to be removably coupled to the lower turbine casing shell 11 by fastening elements arrayed along horizontal joints 13 and 14. The process of removably coupling the upper turbine casing shell 12 to the lower turbine casing shell 11 is resource and time intensive and conducted by initially attaching the upper turbine casing shell 12 to a crane specifically designed for lifting turbine casing shell parts. The process further includes removing each of the fastening elements along the entire axial length of the horizontal joints 13 and 14 so that the upper turbine casing shell 12 can be lifted from the lower turbine casing shell 11.

In some conventional cases, it is not necessary to remove the upper turbine casing shell 12 from the lower turbine casing shell 11 in order to conduct normal inspection and repair operations. In such cases, access to the interior of the turbine casing 10 may be provided via a small (i.e., 2 cm or less) borescope opening 15 that may be formed in the upper turbine casing shell 12. During turbomachine operational modes, the borescope opening 15 is closed by a closure element that is threadably secured in the borescope opening 15. Thus, the closure element may be removed from the borescope opening 15 by rotation of the closure element about the radial dimension. As such, due to both ease of manufacture and the curvature of the turbine casing 10, the borescope opening 15 is typically circular and a diameter thereof is required to be maintained at a relatively small scale to reduce stress concentrations on the casing and so that the closure element can register with the threading. Also, the borescope opening 15 need not be larger than the small-diameter borescope itself to avoid unnecessarily reducing the structural strength of the turbine casing 10.

Since the diameter of the borescope opening 15 is small, it is generally not possible to conduct complete inspection and repair operations that require greater access to a turbomachine interior than what is provided via the borescope opening 15 (i.e., small to intermediate scale inspections and repairs) without removing the upper turbine casing shell 12 from the lower turbine casing shell. Consequently, small to intermediate scale inspections and repairs are often associated with outsized costs and turbomachine 10 downtime associated with the resource and time intensive removal process described above. Accordingly, at least one of the upper and lower turbine casing shells 12 and 11 is formed to define an access slot 20 in which the service wedge 30 is sized to fit. The service wedge 30 can therefore be removably installed with respect to the access slot 20 by manual procedures that can be executed quickly or at least more quickly than the full upper turbine casing shell 12 removal process described above.

In accordance with aspects, the manual procedures may be conducted with efficiency improvement from hoists or cranes that are generally smaller than those used for full casing shell removal. As the upper and lower turbine casing shells 12 and 11 can weigh several tons, the hoists or cranes needed for full removal must have the capability of lifting several tons or more. By contrast, the hoists or cranes that may be required to assist in the removal of the service wedge need to be capable of lifting substantially less weight (e.g., on the order of several hundred pounds or less).

During turbomachine operations, the service wedge 30 is installed in the access slot 20. The service wedge 30 can be removed from the access slot 20 to allow for small to intermediate scale inspections and repairs without otherwise removing the entire upper turbine casing shell 12 from the lower turbine casing shell 11. The access slot 20 thus provides for less costly repairs and inspections and less turbomachine downtime as well.

Although the access slot 20 may be defined by one or both of the upper and lower turbine casing shells 12 and 11, the following description will relate to the exemplary case of the access slot 20 being defined by the upper turbine casing shell 12. This is being done for clarity and brevity and is not intended to otherwise limit the scope of the application or the claims.

In accordance with embodiments, the access slot 20 may be defined by the upper turbine casing shell 12 to have a circumferential arc-length of adequate dimensions to allow access to and/or removal of specific internal components yet remain sized for fast and efficient removal. Even if the access slot 20 extends along substantially an entire axial length of the turbine casing 10 (e.g., from forward flange 40 to aft flange 41), the access slot 20 may have a relatively short arc-length and thereby allow the corresponding service wedge 30 to remain correspondingly lightweight. As the service wedge 30 is configured to be removably installed in the access slot 20 by manual procedures (with or without receiving some efficiency improvement from the aforementioned hoists or cranes), the lightweight characteristic of the service wedge 30 permits the service wedge 30 to be lifted out of the access slot 20 manually or by use of the relatively small hoists or cranes.

Of course, it is to be understood that the illustrations of the access slot 20 in the figures are merely exemplary and that other larger and smaller access slot 20 shapes and sizes may be employed as long as the corresponding service wedge 30 is sufficiently lightweight to be quickly and efficiently removable by manual or hoist/crane assisted procedures. In addition, although the access slot 20 is illustrated as having a regular shape, it is to be understood that this is not necessary and that it is possible that the access slot 20 may have a regular, irregular, angled, rounded or otherwise complex shape as shown in FIG. 3.

The access slot 20 may be defined along a centerline 120 of the upper turbine casing shell 12 or at an offset position relative to the centerline 120. In either case, the access slot 20 may be but is not required to be defined symmetrically about the centerline 120 to thereby preserve thermal expansion and contraction characteristics of the turbine casing 10. In the case where the access slot 20 is defined at the offset position, the access slot 20 may be defined as multiple access slots 20. In this case, one of the access slots 20 may be defined at a first offset position relative to the centerline 120 and another access slot 20 may be defined at a second offset position on the opposite side of the centerline 120 from the first offset position. In accordance with embodiments, the first and second offset positions may be defined at or near flexural nodal locations (e.g., the 1:30 and 10:30 positions, respectively) of the upper turbine casing shell 12.

In the case where the upper turbine casing shell 12 defines multiple access slots 20, the service wedge 30 may be provided as multiple service wedges 30 and/or multiple dummy wedges 31. In either case, each one of the multiple service wedges 30 or dummy wedges 31 is configured to be removably installed in a corresponding one of the multiple access slots 30. A dummy wedge may be a casing modification that geometrically mimics the design of the service wedge 30 and provides for similar thermal and mechanical casing responses in a circumferentially symmetric location on the casing to prevent distortions such as out-of-roundness. Such a device may also be referred to as "a false flange" or "a false wedge."

Figure 4:
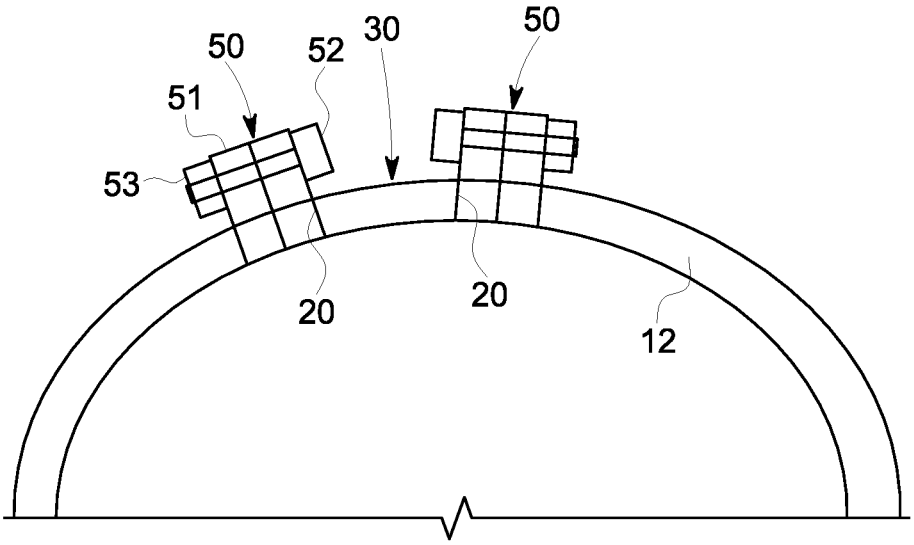
FIG. 4 is an enlarged axial view of a portion of the turbine casing of FIG. 1 and a service wedge.

With reference to FIG. 4 and, in accordance with embodiments, the service wedge 30 may be secured in the access slot 20 by wedge fastening elements 50. The wedge fastening elements 50 include flanges 51 extending from corresponding long-edge portions of both the upper turbine casing shell 12 and the service wedge 30 and combinations of bolts 52 and nuts 53. The bolts 52 extend through through-holes defined in the flanges 51 and threadably engage with the nuts 53 to secure the flanges 51 together and to thereby secure the service wedge 30 in the access slot 20.

Although the flanges 51 are illustrated in FIG. 4 as extending in the axial dimension along the corresponding long-edge portions of the upper turbine casing shell 12 and the service wedge 30, it is to be understood that this configuration is not required and that other arrangements are possible. For example, the flanges 51 could be arranged along the long-edge portions, the short-edge portions or both the long and short-edge portions. In any case, a number of the bolt/nut combinations may be maintained below a predefined number as long as the service wedge 30 can be secured in the access slot 20 so that the time required to remove the service wedge 30 can remain desirably short. In accordance with embodiments, the bolt/nut combinations may be arranged so that the bolts 52 extend along the axial or circumferential dimensions (as opposed to the radial dimension).

Figure 5:
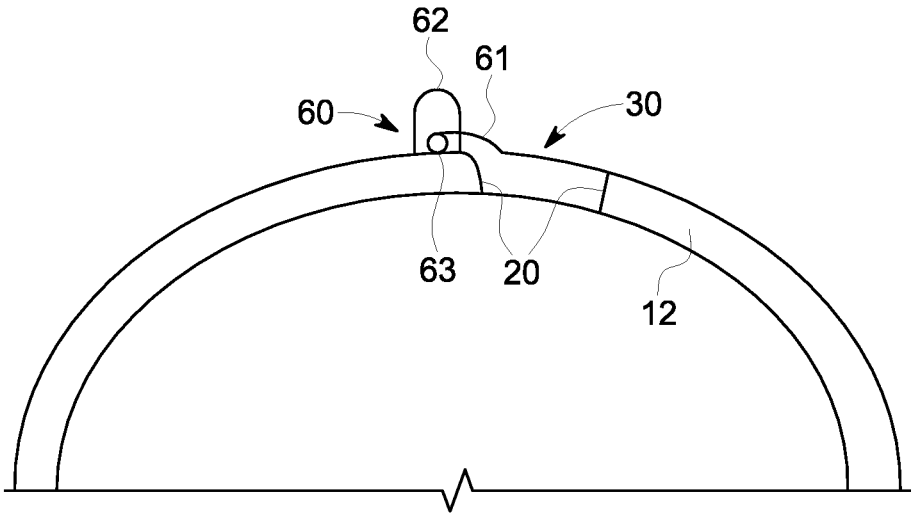
FIG. 5 is an axial view of a service wedge with a hinge.

With reference to FIG. 5, the service wedge 30 may be hingeably coupled to the upper turbine casing shell 12 via hinge assembly 60. For example, the service wedge 30 may include hinge arm 61 that projects radially outwardly and circumferentially from a side of the service wedge 30 while the upper turbine casing shell 12 may include a guide element 62. A boss or hinge-pin 63 may be disposed to extend through the hinge arm 61 and the guide element 62. In such a case, the service wedge 30 can be removed from the access slot 20 by removing any fastening elements in use and then withdrawing the service wedge 30 radially outwardly until the hinge-pin 63 reaches the distal end of the guide element 62. At this point, the service wedge 30 can be pivoted around the hinge-pin 63 to complete the service wedge 30 removal process.

In accordance with further embodiments, it is to be understood that the borescope opening 15 may not be required where the access slot 20 is formed. In such cases, the borescope may simply by snaked through the access slot 20 with the service wedge 30 removed. If the borescope is required to be secured in place, appropriate tooling may be provided to do so within the scope of this disclosure.

Figure 6:
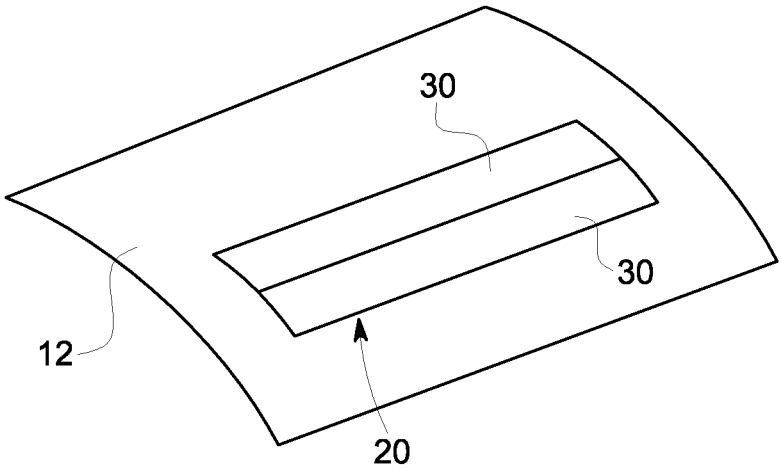
FIG. 6 is a schematic perspective view of multiple service wedges in accordance with embodiments.
Figure 7:
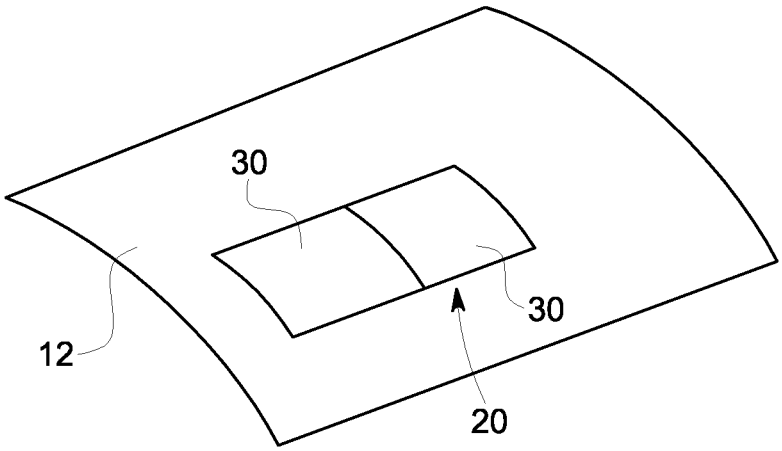
FIG. 7 is a schematic perspective view of multiple service wedges in accordance with alternative embodiments.
Figure 8:
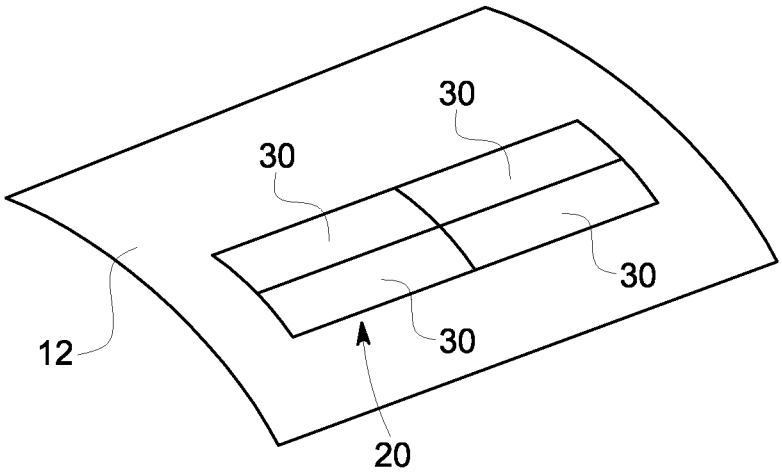
FIG. 8 is a schematic perspective view of multiple service wedges in accordance with further alternative embodiments.

With reference to FIGS. 6-8 and, in accordance with further embodiments, multiple service wedges 30 may be removably installed in a single access slot 20. In such cases, the multiple service wedges 30 may be removed as a single unit or one at a time by manual procedures similar to the procedures described above. The use of multiple service wedges 30 in a single access slot 20 may permit greater flexibility in access slot 20 sizing as well as greater flexibility in service procedures. That is, for a given service requiring limited access, only one of the multiple service wedges 30 may be removed while all of the multiple service wedges 30 may be removed for more substantial services procedures.

Although FIG. 6 illustrates the multiple service wedges 30 being arranged in the access slot 20 in the circumferential dimension, it is to be understood that this is not required and that the multiple service wedges 30 can be arranged in other dimensions. For example, the multiple service wedges 30 may be arranged in the circumferential dimension (i.e., in a 2×1 matrix, see FIG. 6), in the axial dimension (i.e., in a 1×2 matrix, see FIG. 7) or in the axial and circumferential dimensions (i.e., in a 2×2 matrix, see FIG. 8).

Figure 9:
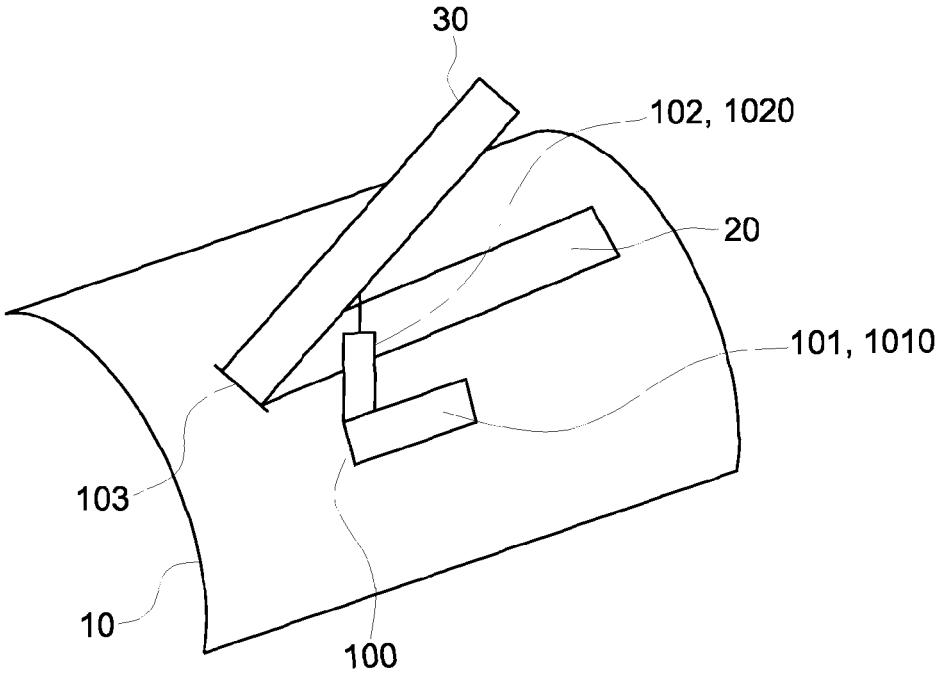
FIG. 9 is a schematic perspective view of a lift efficiency improvement mechanism in accordance with embodiments.
Figure 10:
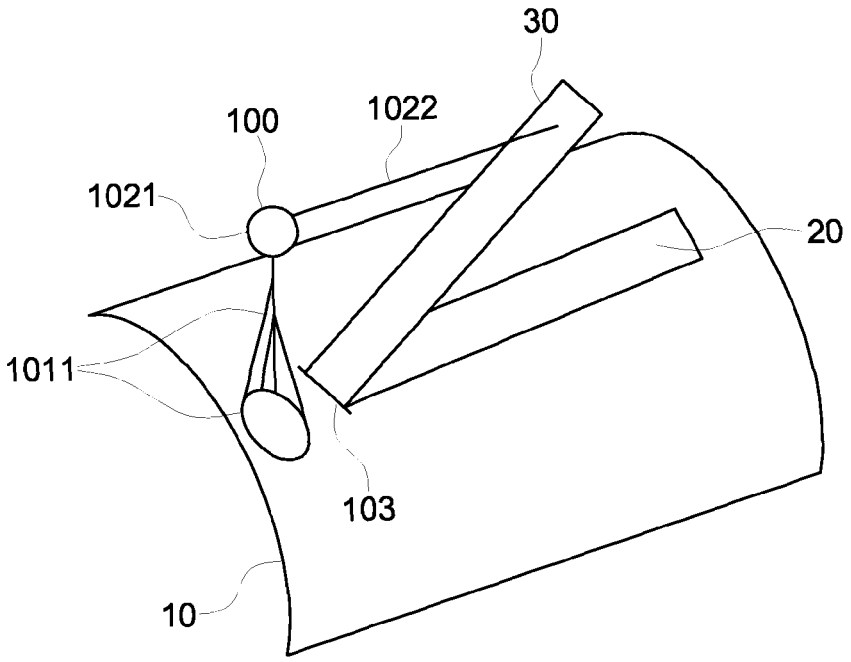
FIG. 10 is a schematic perspective view of a lift efficiency improvement mechanism in accordance with alternative embodiments.

With reference to FIGS. 9 and 10 and, in accordance with further aspects of the invention, a lift efficiency improvement mechanism 100 is provided for use with a service wedge 30 (as described above) that is configured to be removably installed in an access slot 20 of a turbine casing 10. The lift efficiency improvement mechanism 100 includes a connector element 101 and a manually transportable lift efficiency improvement device 102, which in some cases, may be a force multiplication device. The connector element 101 may be a substantially rigid structural element that is connectable with an outer surface, a flange, a fastening element or some other suitable surface feature of the turbine casing 10 at a location that is proximate to the access slot 20. The service wedge 30 may be movable relative to the access slot 20 in a substantially radial direction defined in relation to a radial dimension of the turbine casing 10. Alternatively, as shown in FIGS. 9 and 10, the service wedge 30 may be rotationally movable about a hinge 103 relative to the access slot 20.

Where the lift efficiency improvement device 102 is provided as a force multiplication device, the lift efficiency improvement device 102 may include a hydraulic or pneumatic jack (see FIG. 9) or winch (see FIG. 10) and is supportably coupled to the connector element 101 and movably coupled to the service wedge 30. In the former case, as shown in FIG. 9, the connector element 101 may include an elongate part 1010 that is attachable to the turbine casing 10 and the lift efficiency improvement device 102 may include a pneumatic or hydraulic jacking element 1020 that is operably disposed between the connector element 101 and the service wedge 30. In the latter case, as shown in FIG. 10, the connector element 101 may include a support structure 1011 that is attachable to the turbine casing 10 and the lift efficiency improvement device 102 may include a pneumatic or hydraulic winching element 1021 and a cable 1022. In this case, the cable 1022 is coupled to the service wedge 30 and connected to the pneumatic or hydraulic winching element 1021 whereby the pneumatic or hydraulic winching element 1021 acts on the cable 1022 to control movement of the service wedge 30. In either case, the lift efficiency improvement 102 is configured to urge the service wedge 30 to move relative to the access slot 20 in response to corresponding operator control movement (i.e., jacking of the pneumatic or hydraulic jacking element 1020).

Figure 11:
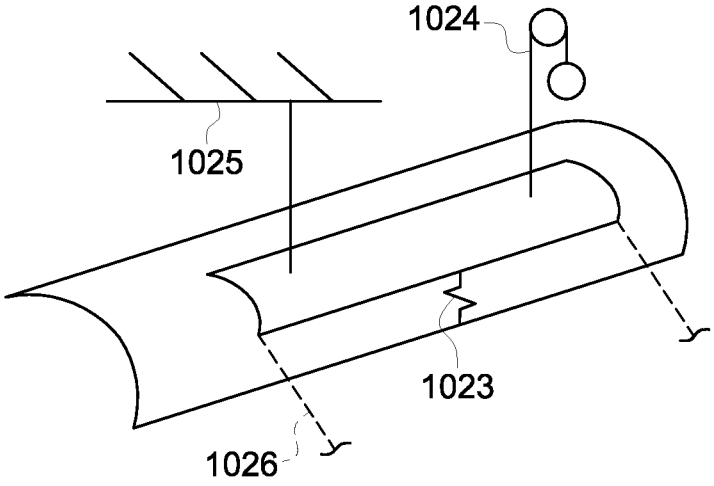
FIG. 11 is a schematic perspective view of lift efficiency improvement mechanisms in accordance with alternative embodiments.

With reference to FIG. 11, the lift efficiency improvement device 102 may be provided as at least one of the force multiplication device described above, a force addition device and a guidance tool.

Where the lift efficiency improvement device 102 is provided as a force addition device, the lift efficiency improvement device 102 may include at least one of a spring-loading 1023, a counterweight 1024 and a relatively low capacity, manually transportable crane 1025. In the case of the spring-loading 1023, an elastic element such as a spring may be operably disposed between the turbine casing 10 and the service wedge 30. When the service wedge 30 is to be removed from the access slot 20 and any fastening elements securing the service wedge 30 in place are disengaged, the spring-loading 1023 can be employed to provide a boost to the operator so that the operator is not required to initiate a movement of the service wedge 30 from a stationary position. In the case of the counterweight 1024, the counterweight 1024 may be attachable to the service wedge 30 when the service wedge 30 is to be removed from the access slot such that the counterweight 1024 effectively reduces the weight of the service wedge 30. The low capacity, manually transportable crane 1025 operates in a similar manner as the counterweight and effectively reduces the weight of the service wedge 30.

Where the lift efficiency improvement device 102 is provided as a guidance tool, the lift efficiency improvement device 102 may include guide rails 1026 that guide the movement of the service wedge 30 during installation and removal of the service wedge 30 with respect to the access slot 20. In particular, the guide rails 1026 may be provided with relatively shallow angles such that any vertical lifting component of service wedge 30 movement is limited.

At least one or both of the connector element 101 and the lift efficiency improvement device 102 are manually transportable. That is, at least one or both of the connector element 101 and the lift efficiency improvement device 102 may be sufficiently lightweight to be lifted and carried by an operator to and from the turbine casing 10. Moreover, in accordance with embodiments, at least one or both of the connector element 101 and the lift efficiency improvement device 102 may be sufficiently lightweight to be manually manipulated into position on the turbine casing 10 by the operator without risking damage to the turbine casing 10.

It is to be understood that the various embodiments illustrated in the drawings and, particularly, FIGS. 9-11 can be interchangeable or combinable in various configurations regardless of the arrangements shown in drawings themselves.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A lift efficiency improvement mechanism for use with a service wedge configured to be removably installed in an access slot of a turbine casing, the access slot being elongate and configured for providing access to internal rotor components along a longitudinal axis of the turbine casing with the service wedge uninstalled, the lift efficiency improvement mechanism comprising:

a connector element, which is connectable with the turbine casing proximate to the access slot; and a manually transportable lift efficiency improvement device, which is supportably coupled to the connector element and movably coupled to the service wedge, the lift efficiency improvement device being configured to urge the service wedge to move relative to the access slot responsive to corresponding operator control movement.

2. The lift efficiency improvement mechanism according to claim 1, wherein the service wedge is radially movable relative to the access slot.

3. The lift efficiency improvement mechanism according to claim 1, further comprising a hinge by which the service wedge is coupled to the turbine casing.

4. The lift efficiency improvement mechanism according to claim 3, wherein the service wedge is rotationally movable about the hinge relative to the access slot.

5. The lift efficiency improvement mechanism according to claim 1, wherein the connector element comprises a support structure.

6. The lift efficiency improvement mechanism according to claim 1, wherein the lift efficiency improvement device comprises a force addition device.

7. The lift efficiency improvement mechanism according to claim 6, wherein the force addition device comprises at least one of a spring-loading, a counter-weight and a crane.

8. The lift efficiency improvement mechanism according to claim 1, wherein the lift efficiency improvement device comprises a guidance tool.

9. The lift efficiency improvement mechanism according to claim 1, wherein the lift efficiency improvement device comprises a force multiplication device.

10. The lift efficiency improvement mechanism according to claim 9, wherein the force multiplication device comprises at least one of a jack and a winch.

11. A lift efficiency improvement mechanism for use with a service wedge configured to be removably installed in an access slot of a turbine casing, the access slot being elongate and configured for providing access to internal rotor components along a longitudinal axis of the turbine casing with the service wedge uninstalled, the lift efficiency improvement mechanism comprising:

a connector element, which is connectable with the turbine casing proximate to the access slot; and a force multiplication device, which is supportably coupled to the connector element and movably coupled to the service wedge, the connector element and the force multiplication device being manually transportable, and the force multiplication device being configured to urge the service wedge to move relative to the access slot responsive to corresponding operator control movement.

12. The lift efficiency improvement mechanism according to claim 11, wherein the service wedge is radially movable relative to the access slot.

13. The lift efficiency improvement mechanism according to claim 11, further comprising a hinge by which the service wedge is coupled to the turbine casing.

14. The lift efficiency improvement mechanism according to claim 13, wherein the service wedge is rotationally movable about the hinge relative to the access slot.

15. The lift efficiency improvement mechanism according to claim 11, wherein the connector element comprises a support structure.

16. The lift efficiency improvement mechanism according to claim 11, wherein the force multiplication device comprises a jack.

17. The lift efficiency improvement mechanism according to claim 11, wherein the force multiplication device comprises a winch.

18. A method of improving lift efficiency of a service wedge configured to be removably installed in an access slot of a turbine casing, the access slot being elongate and configured for providing access to internal rotor components along a longitudinal axis of the turbine casing with the service wedge uninstalled, the method comprising:

disposing a connector element in connection with the turbine casing proximate to the access slot;

manually transporting a lift efficiency improvement device to the connector element;

supportably coupling the lift efficiency improvement device to the connector element;

movably coupling the lift efficiency improvement device to the service wedge; and employing the lift efficiency improvement device to urge the service wedge to move relative to the access slot.

19. The method according to claim 18, wherein the lift efficiency improvement device comprises at least one of a force addition device, a guidance tool and a force multiplication device.

20. The method according to claim 18, wherein the employing the lift efficiency improvement device to urge the service wedge to move comprises at least one of urging the service wedge to move linearly and rotationally.

* * * * *